US005902190A

United States Patent [19]

Masutani et al.

[11] Patent Number: 5,902,190

[45] Date of Patent: May 11, 1999

[54] GOLF BALL WITH DEFINED COATING LAYER

[75] Inventors: Yutaka Masutani; Keisuke Ihara; Hirotaka Shimosaka; Michio Inoue; Atuki Kasasima, all of Saitama, Japan

[73] Assignee: Bridgestone Sports Co., Ltd., Tokyo, Japan

[21] Appl. No.: 08/840,754

[22] Filed: Apr. 16, 1997

[30] Foreign Application Priority Data

Apr. 17, 1996 [JP] Japan ..... 8-119658

[51] Int. Cl.[6] ..... A63B 37/12; A63B 37/14

[52] U.S. Cl. ..... 473/365; 473/377; 473/378; 473/383

[58] Field of Search ..... 473/378, 365, 473/377, 383, 384

[56] References Cited

U.S. PATENT DOCUMENTS

| | | | |
|---|---|---|---|
| 3,177,280 | 4/1965 | Ford et al. | 473/378 X |
| 5,506,004 | 4/1996 | Maruoka et al. | 473/378 |
| 5,669,831 | 9/1997 | Lutz | 473/377 |
| 5,743,818 | 4/1998 | Maruoka et al. | 473/383 X |
| 5,744,549 | 4/1998 | Lutz | 473/378 X |

*Primary Examiner*—George J. Marlo
*Attorney, Agent, or Firm*—Sughrue, Mion, Zinn, Macpeak & Seas, PLLC

[57] ABSTRACT

A golf ball includes a coating layer which has a thickness of 50–700 μm and is formed at the surface portion of the golf ball. When a three-piece golf ball, for example, is prepared, a solid core is enclosed with a cover material having a two-layer structure composed of inner and outer cover layers, and mark stamping is then performed on the cover material. Subsequently, a transparent coating layer having a thickness of 50–700 μm and made of a thermoplastic resin is formed as an outermost layer. It is possible to impart a desired surface hardness and surface friction coefficient to the golf ball without taking account of the overall structure of the golf ball and the relationship between the hardness of the core and the hardness of the cover, thereby increasing the degree of freedom in designing of the golf ball, especially, in designing of the surface hardness and the surface friction coefficient. The coating layer is formed by dispersion coating using a water system emulsion prepared by dispersing a thermoplastic urethane resin powder in water.

5 Claims, 2 Drawing Sheets

GOLF BALL WITH DEFINED COATING LAYER

BACKGROUND OF THE INVENTION

1. Field of the Invention

The present invention relates to a golf ball having a coating layer (a layer formed by coating) at its surface portion.

2. Related Art

Multi-piece golf balls such as two-piece golf balls and three-piece golf balls, and thread-wound golf balls are usually produced by a process which comprises enclosing a solid core or a thread-wound core with a cover material and forming dimples by compression or injection molding; applying a coating on the surface of the cover material; conducting mark stamping by a transfer printing method; and then forming an outermost layer coating of the ball. In some cases, the mark stamp may be directly applied to the cover material surface, and then an outermost layer coating may be formed. One-piece golf balls are produced by a process which comprises preparing a solid core having dimples by compression or injection molding, and then subjecting the solid core to mark stamping and the application of an outermost layer coating of the ball in this order.

In such conventional golf balls, the coating layer formed on the surface of the cover material and the coating layer formed as the outermost layer of the golf ball are very thin and their thicknesses are in the range of 15–35 μm. The main reasons why the coating layers at the surface portion of the golf balls have been made thin are as follows:

(a) The coating layer formed on the cover material or formed as the outermost layer protects the golf ball from dirt or scratches and to improve the appearance thereof. For such purposes, it is sufficient for the coating layer to have a thickness of about 15–35 μm.

(b) When coating is performed after formation of dimples, the coating layer shallows the dimples and dulls dimple edges if formed relatively thick on the dimples. This impairs preciseness of the dimple shape. Accordingly, the thickness of the coating layer must be made as thin as possible in order to prevent the coating layer from impairing preciseness of the dimple shape.

However, the conventional golf balls in which the coating layer at the surface portion has a thickness of about 15–35 μm have the following problems. That it, since the coating layer at the surface portion is thin, the surface coating hardly affects the characteristics of the ball. Therefore, the surface hardness of the golf ball depends on the hardness of the cover, and the surface friction coefficient of the golf ball, which correlates with the surface hardness of the golf ball, depends on the surface friction coefficient of the cover. Consequently, the surface friction coefficient of the golf ball becomes small when the hardness of the cover is high, while the surface friction coefficient of the golf ball becomes large when the hardness of the cover is low.

The cover of a golf ball is generally formed by directly injecting a cover material around a solid core or thread-wound core, or by enclosing the solid core or thread-wound core with previously injection-molded hemisphere cover materials (half cups), and conducting compression molding. Therefore, the lower limit of the thickness of the cover is about 1.2–1.3 mm, and it is difficult to form a cover having a thickness less than the limit through compression molding or injection molding.

Accordingly, in high-spin type golf balls with a cover which has a low hardness and a large surface friction coefficient (for example, a hardness of about 55 on the Shore D Scale), the core must be made hard in order to prevent the repulsiveness of the golf ball itself from decreasing due to its soft and thick cover. In this case, feel on impact becomes hard. In soft type golf balls having a relatively soft core, the cover must be made hard (for example, a hardness of about 65 on the Shore D Scale) in order to prevent the repulsiveness of the golf ball itself from decreasing due to its soft core. As a result, the surface friction coefficient of the golf ball decreases, so that only a low-spin performance can be obtained.

In short, in the conventional golf ball, since the coating layer is thin, the coating layer hardly affects the characteristics of the ball, so that the surface hardness and surface friction coefficient of the golf ball depends only on the surface hardness and surface friction coefficient of the cover. Therefore, the surface hardness and surface friction coefficient of a golf ball must be determined in the designing process, taking into consideration the overall structure of the golf ball and the relationship between the hardness of the core and the hardness of the cover, as in the above-mentioned examples of the high-spin type golf ball and the soft type golf balls. This decreases the degree of freedom in designing of the golf ball, especially, in designing of the surface hardness and the surface friction coefficient. As a result, it has been impossible to mitigate the problem of the high-spin type golf balls, i.e., hard feel on impact, or the problem of the soft type golf balls, i.e., low-spin performance.

SUMMARY OF THE INVENTION

The present invention was made in view of the above problems, and an object of the present invention is to provide a golf ball in which a desired surface hardness and surface friction coefficient can be imparted to the golf ball without taking account of the overall structure of the golf ball and the relationship between the hardness of the core and the hardness of the cover, thereby increasing the degree of freedom in designing of the golf ball, especially, in designing of the surface hardness and the surface friction coefficient.

To achieve the above object, the present invention provides a golf ball comprising a coating layer having thickness of 50–700 μm and formed at the surface portion thereof. Preferably, the golf ball of the present invention comprises a main body and one or more coating layers formed on the main body, at least one of the coating layers having thickness of 50–700 μm.

In the golf ball of the present invention, since the thickness of the coating layer at the surface portion is increased to fall in the range of 50–700 μm, the coating layer greatly affects the characteristics of the ball. As a result, it becomes possible to set the surface hardness and surface friction coefficient of the golf ball through selection of characteristics of the coating layer, without taking account of the overall structure of the golf ball and the relationship between the hardness of the core and the hardness of the cover. Since the surface hardness and surface friction coefficient of the golf ball can be set through selection of characteristics of the coating layer, the degree of freedom in designing of the golf ball, especially, in designing of the surface hardness and the surface friction coefficient can be increased.

The thick coating layer having a thickness of 50–700 μm employed in the present invention increases the ratio of the volume of the coating layer with respect to the total volume of the golf ball, so that the characteristics of the coating layer affects the traveling performance and spin performance of the golf ball and feel on impact. Therefore, in the golf ball of the present invention, it is possible to provide the coating layer with functions that contribute to the traveling performance and spin performance of the golf ball and feel on impact, through selection of the characteristics of the coating layer, which selection is made through selection of the kind and thickness of the coating layer.

DESCRIPTION OF THE PREFERRED EMBODIMENTS

Figure 1:
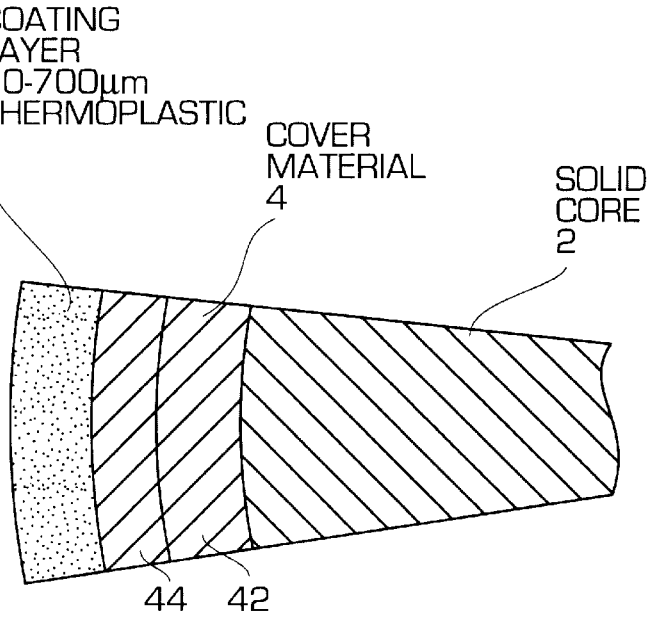
FIG. 1 is a partially enlarged sectional view showing a golf ball according to an embodiment of the present invention.

The present invention will now be described in further detail.

In the present invention, a coating layer having a thickness of 50–700 μm is formed at the surface portion of a golf ball. When the thickness of the coating layer is less than 50 μm, it becomes difficult for the coating layer to affect the characteristics of the ball. This makes it difficult to set the surface hardness and surface friction coefficient of the golf ball through selection of characteristics of the coating layer, so that the degree of freedom in designing of the golf ball decreases. When the thickness of the coating layer is greater than 700 μm, it becomes difficult to obtain a stable coating layer due to formation of cracks and drooping of coating material, so that the performance of the golf ball deteriorates. More preferably, the coating layer formed at the surface portion of the golf ball has a thickness in the range of 100–400 μm, most preferably in the range of 150–250 μm. When two or more coating layers are formed at the surface portion of the golf ball (see FIG. 2, for example), the thickness of each coating layer is determined to fall within the range of 50–700 μm.

No limitations are imposed on the method of forming the coating layer, and any arbitrary coating method may be employed. Examples of preferred coating methods include a dip coating method, a powder coating method, a dispersion coating method, and a coating method utilizing a hot melt dispenser (hot melt spray gun). In the powder coating method, a powder paint, which is one kind of non-solvent type paint, is applied onto a surface to be coated. Subsequently, the powder paint thus applied is subjected to heat fusion, or a cross-linking reaction is caused, thereby forming a coating layer. In the dispersion coating method, a resin powder is dispersed in water or an organic solvent together with an adequate additive, the resulting emulsion is applied onto the surface of a material by a dipping method or a spraying method, and drying the coated material, followed by heating at a predetermined temperature to form a coating layer. In the coating method utilizing a hot melt dispenser, a thermoplastic resin is expelled from the hot melt dispenser in a spiral shape, in the form of spray, or in a sheet-like shape, and the thus expelled thermoplastic resin is applied to the surface to be coated.

In the present invention, no limitations are imposed on the kinds of paints used in the formation of the coating layer. However, it is preferred to use a thermoplastic resin based paint or a thermosetting resin based paint. Examples of such paints include vinyl acetate resin based paints, vinyl acetate copolymer resin based paints, EVA (ethylene-vinyl acetate copolymer resin) based paints, acrylic ester (co)polymer resin based paints, epoxy resin based paints, thermosetting urethane resin based paints, thermoplastic urethane resin based paints, thermosetting acrylic resin based paints, and unsaturated polyester resin based paints. Particularly preferred are epoxy resin based paints, thermosetting urethane resin based paints, thermoplastic urethane resin based paints, and acrylic ester (co)polymer resin based paints. Most preferred are thermoplastic urethane resin based paints, in view of excellent moldability for forming dimples and excellent durability of a coating formed thereof.

When the coating layer is formed of a thermoplastic resin, the coating layer is easily deformed upon application of heat and pressure. This makes it possible to form dimples through application of heat and pressure after the formation of the coating layer. Therefore, the golf ball of the present invention has an advantage that dimples having a precise shape can be obtained. That is, coating has conventionally been performed using mainly a two-pack system coating material. Since a coating layer formed by this material is not easily deformed upon application of heat and pressure, it is difficult to form dimples after the formation of the coating layer. Therefore, the coating layer has conventionally been formed after formation of dimples. In this case, due to the coating layer is formed on the dimples, the shape preciseness of the dimples may deteriorate. By contrast, when the coating layer is formed by a thermoplastic resin, dimples can be formed after the formation of the coating layer, so that the shape preciseness of the dimples is prevented from deteriorating due to the coating layer. Accordingly, precise dimples can be obtained.

When a thermosetting resin based paint is used, it is possible to form dimples on the cover material through the coating layer and to set the coating layer at the same time, by carrying out compression molding under application of heat after the application of the pint, so that precise dimples can be obtained.

Accordingly, a golf ball according to the present invention can be properly produced by a method in which a coating layer having a thickness of 50–700 μm and made of a thermoplastic resin and/or a thermosetting resin is formed on a main body of the golf ball in which dimples have not been formed, and dimples are then formed by compression molding through the coating layer. This process makes it possible to provide dimples each having a precise shape and a sharp edge while preventing the preciseness of the dimples from deteriorating due to the coating layer, so that the traveling performance of the golf ball can be improved. In this specification, the term "main body" means a solid core enclosed with a cover in the case of multi-piece golf balls such as two-piece and three-piece golf balls, a thread-wound core enclosed with a cover in the case of thread-wound golf balls, and a solid core itself in the case of one-piece golf balls.

In the golf balls of the present invention, the coating layer having a thickness of about 50–700 μm is formed as follows, but is not limited thereto.

① In multi-piece golf balls such as two-piece or three-piece golf balls and thread-wound golf balls, when a coating is applied onto a cover material surface, and then mark stamping is carried out, followed by application of an outermost layer coating, the coating layer on the cover material surface and/or the outermost layer coating is designed to have a thickness of 50–700 μm.

② In multi-piece golf balls such as two-piece or three-piece golf balls and thread-wound golf balls, when a mark is directly stamped onto the bare cover material surface, and then an outermost layer coating of a golf ball is formed, the outermost layer coating is designed to have a thickness of 59–700 μm.

③ In one-piece golf balls, the outermost layer coating is designed to have a thickness of 50–700 μm.

In the golf balls of the present invention, by selecting the properties of the coating layer, the coating layer can be given functions to improve traveling performance, spin performance, and feel on impact. For example, in multi-piece golf balls such as two-piece or three-piece golf balls and thread-wound golf balls, when an outermost layer coating is formed to have a thickness of 50–700 μm, and the hardness of the coating layer is made less than that of a cover, the coating layer can be given a function to improve spin performance of the golf ball.

The present invention will be described in detail with reference to the drawings.

Figure 2:
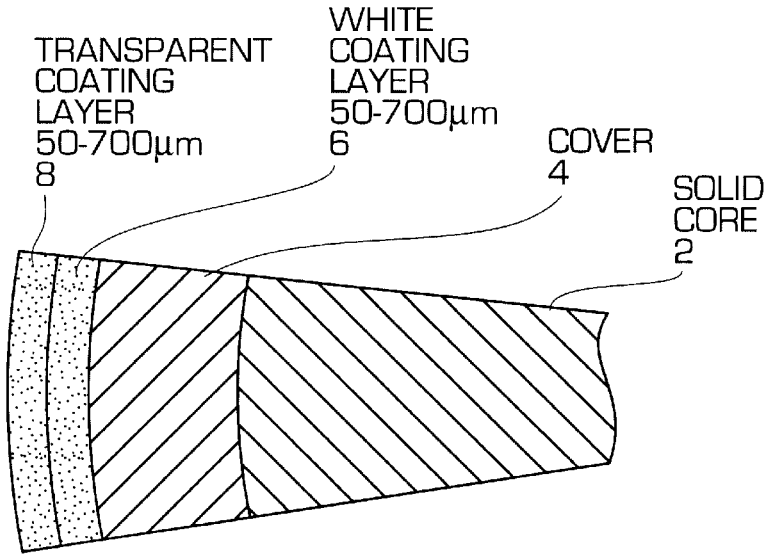
FIG. 2 is a partially enlarged sectional view showing a golf ball according to another embodiment of the present invention.
Figure 3:
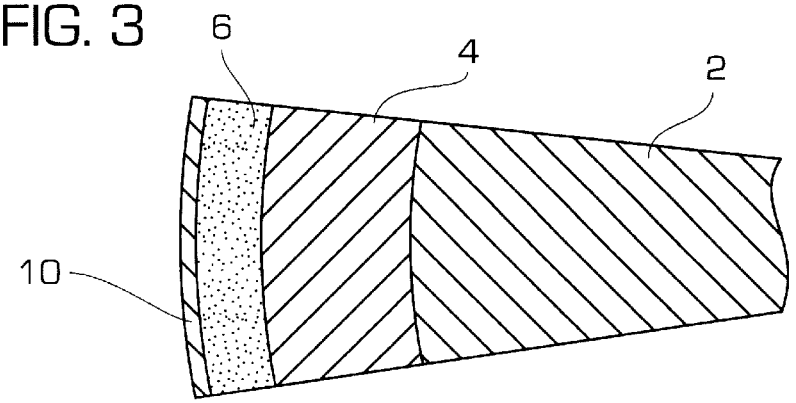
FIG. 3 is a partially enlarged sectional view showing a golf ball according to a further embodiment of the present invention.
Figure 4:
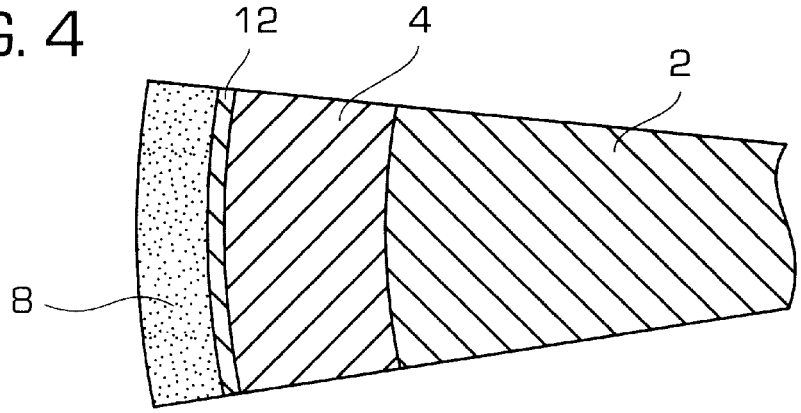
FIG. 4 is a partially enlarged sectional view showing a golf ball according to a further embodiment of the present invention.
Figure 5:
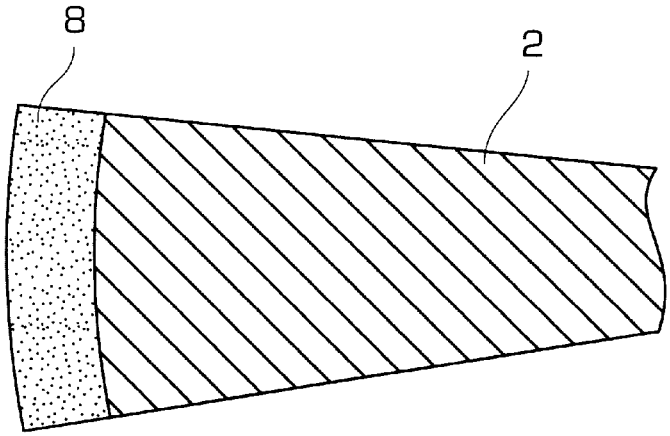
FIG. 5 is a partially enlarged sectional view showing a golf ball according to a further embodiment of the present invention.

FIGS. 1 to 5 are partially enlarged views showing golf balls according to embodiments of the present invention. FIG. 1 shows an embodiment of a three piece ball, FIGS. 2 to 4 show embodiments of two-piece golf balls. FIG. 5 shows an embodiment of a one-piece golf ball. Thread-wound golf balls may be constructed in a manner similar to the multi-piece golf balls of FIGS. 1 to 4. In addition, a mark to be formed by mark stamping and dimples are not shown in FIGS. 1 to 5. The formation of dimples may be performed during the formation of a cover or after the formation of a coating layer.

The three-piece golf ball as shown in FIG. 1 is prepared by enclosing a solid core 2 with a cover material 4 having a two-layer structure composed of an inner cover layer 42 and an outer cover layer 44; conducting mark stamping on the surface of the cover material 4; and forming a transparent coating layer 8 having a thickness of 50–700 μm and made of a thermoplastic resin as an outermost layer.

The two-piece golf ball as shown in FIG. 2 is prepared by enclosing a solid core 2 with a cover material 4 of a single layer; forming a white coating layer 6 having a thickness of 50–700 μm and made of a thermoplastic resin on the surface of the cover material 4; conducting mark stamping on the coating layer 6; and forming a transparent coating layer 8 having a thickness of 50–700 μm and made of a thermosetting resin as an outermost layer. In addition, in the two-piece golf balls as shown in FIG. 2, the coating layer 6 may be made of a thermosetting resin, and the coating layer 8 may be made of a thermoplastic resin. Both the coating layers 6 and 8 may be made of a thermoplastic resin or thermosetting resin.

The two-piece golf ball as shown in FIG. 3 is prepared by enclosing a solid core 2 with a cover material 4 of a single layer; forming a white coating layer 6 having a thickness of 50–700 μm and made of a thermoplastic resin on the surface of the cover material 4; conducting mark stamping on the coating layer 6; and forming a conventional clear coating 10 having a thickness of 15–35 μm as an outermost layer.

The two-piece golf ball as shown in FIG. 4 is prepared by enclosing a solid core 2 with a cover material 4 of a single layer; forming a conventional white coating layer 12 having a thickness of about 15–35 μm and made of a two-pack system coating material on the surface of the cover material 4; conducting mark stamping on the surface of the coating layer 12; and forming a transparent coating layer 8 having a thickness of 50–700 μm and made of a thermoplastic resin as an outermost layer.

The one-piece golf ball as shown in FIG. 5 is prepared by conducting mark stamping on the surface of a solid core 2; and forming a transparent coating layer 8 having a thickness of 50–700 μm and made of a thermoplastic resin as an outermost layer.

EXAMPLES

Three-piece golf balls as shown in FIG. 1 (golf balls A) were produced and were compared with conventional soft type three-piece golf balls having a two-layer cover material (golf balls B). The golf balls B were produced as follows. A solid core having a low hardness (Shore D hardness: 48) was enclosed with a two-layer cover material composed of an inner cover layer (Shore D hardness: 40) and an outer cover layer having a hardness greater than that of the inner cover layer (Shore D hardness: 61). At the same time, dimples were formed. Subsequently, a coating layer having a thickness of 20 μm was formed by applying a two-pack system urethane paint as an outermost layer. The golf balls A of the present invention were prepared as follows. The same solid core as that used for the golf balls B was enclosed with the same two-layer cover material as that used for the golf balls B. Subsequently, a coating layer having a thickness of 200 μm (Shore D hardness: 38) was formed as an outermost layer by a dispersion coating method using a water system emulsion prepared by dispersing a thermoplastic urethane resin powder in water. In the golf balls A, precisely shaped, sharp-edged dimples were obtained, which were as precise and sharp as uncoated dimples of the conventional golf balls which have been just prepared by enclosing a core with a cover material, and then forming dimples thereon. In the preparation of the golf balls A, the surface of the cover is ground after the formation of the cover to make the outer diameter of the golf balls A equal to the outer diameter of the golf balls B.

The spin performances of the golf balls A and B were tested. Testing was performed using a hitting test machine in which golf balls were hit with different clubs at different head speed as shown in Table 1 and spin quantity was measured. The results of the test are shown in Table 1 and FIG. 6.

TABLE 1

Figure 6:
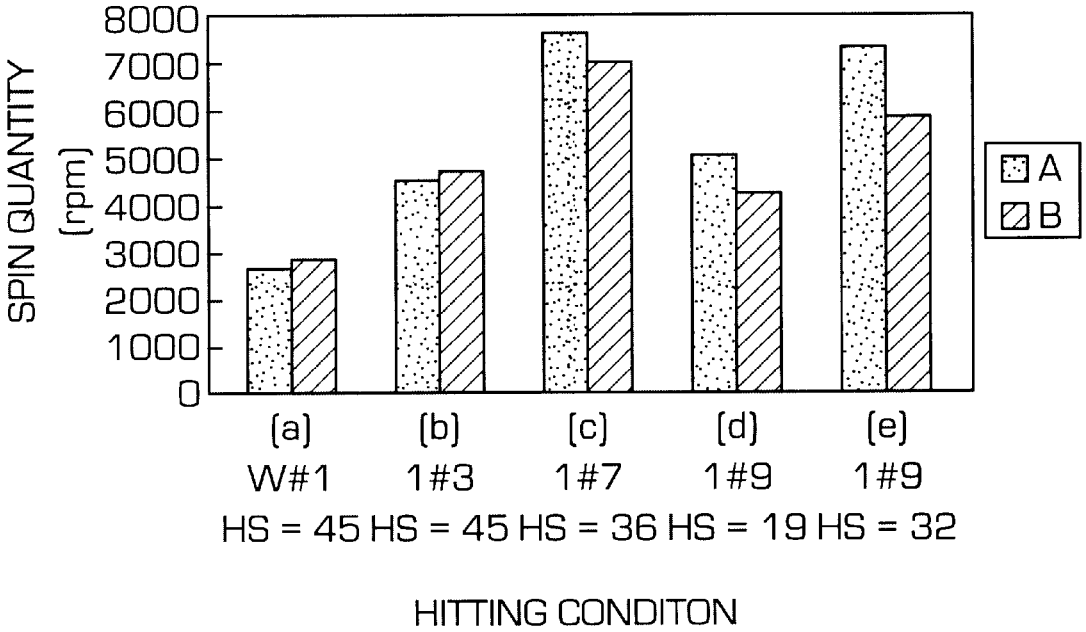
FIG. 6 is a graph showing the relationship between hitting conditions and spin quantity obtained in a hitting test that was performed using golf balls of the present invention and conventional golf balls.

| | Club used | | | | |
|---|---|---|---|---|---|
| | No. 1 wood | No. 3 iron | No. 7 iron | No. 9 iron | No. 9 iron |
| | Head speed | | | | |
| | 45 m/s | 45 m/s | 36 m/s | 19 m/s | 32 m/s |
| Spin quantity (rpm) | | | | | |
| Golf ball A | 2759 | 4593 | 7783 | 4955 | 7423 |
| Golf ball B | 2900 | 4743 | 7187 | 4223 | 5881 |
| Correspondence to FIG. 6 | (a) | (b) | (c) | (d) | (e) |

In the golf balls B, which were conventional soft type golf balls, the surface friction coefficient of each golf ball was affected by the hard outer cover layer, and therefore the spin performance was low for all the clubs. By contrast, the golf balls A of the present invention in which a coating layer having a thickness of 200 μm and a low harness was formed at the surface, the characteristics of the coating layer affected the surface friction coefficient of the golf balls, so that the spin quantity increased when the golf balls hit by short iron clubs. It was found from this test that, in the golf balls of the present invention, the coating layer greatly affects the characteristics of the balls, so that the surface hardness and surface friction coefficient of the golf ball can be set through selection of characteristics of the coating layer. Accordingly, the degree of freedom in designing of the golf ball, especially, in designing of the surface hardness and the surface friction coefficient can be increased.

As described above, in the golf balls of the present invention, it is possible to impart a desired surface hardness and surface friction coefficient to a golf ball without taking account of the overall structure of the golf ball and the relationship between the hardness of the core and the hardness of the cover, thereby increasing the degree of freedom in designing of the golf ball, especially, in designing of the surface hardness and the surface friction coefficient. Also, in the golf balls of the present invention, it is possible to provide the coating layer with functions that contribute to the traveling performance and spin performance of the golf balls and feel on impact.

What is claimed is:

1. A golf ball comprising;

a coating layer having thickness of 150–250 μm as an outermost layer, said coating layer formed by dispersion coating using a water system emulsion prepared by dispersing a thermoplastic urethane resin powder in water.

2. A golf ball according to claim 1, wherein the coating layer is formed of a thermoplastic resin based paint and/or a thermosetting resin based plaint.

3. A golf ball according to claim 2, wherein the paint is selected from vinyl acetate resin based paints, vinyl acetate copolymer resin based paints, EVA (ethylene-vinyl acetate copolymer resin) based paints, acrylic ester (co)polymer resin based paints, epoxy resin based paints, thermosetting urethane resin based paints, thermoplastic urethane resin based paints, thermosetting acrylic resin based paints, and unsaturated polyester resin based paints.

4. A golf ball according to claim 1, wherein the golf ball comprises a main body and a second coating layer formed on the main body, at least one of the coating layers having thickness of 50–700 μm.

5. A golf ball according to claim 4, wherein the main body is a solid core enclosed with a cover, a thread-wound core enclosed with a cover, or a solid core itself.

* * * * *